US006941597B2

(12) United States Patent
Hampe

(10) Patent No.: US 6,941,597 B2
(45) Date of Patent: Sep. 13, 2005

(54) HOLDING DEVICE FOR MEDICAL INSTRUMENTS AT A PATIENT'S BED

(75) Inventor: Markus Hampe, Lübeck (DE)

(73) Assignee: Dräger Medical AG & Co., KGaA, Lübeck (DE)

( * ) Notice: Subject to any disclaimer, the term of this patent is extended or adjusted under 35 U.S.C. 154(b) by 0 days.

(21) Appl. No.: 10/459,951

(22) Filed: Jun. 12, 2003

(65) Prior Publication Data

US 2004/0040091 A1 Mar. 4, 2004

(30) Foreign Application Priority Data

Aug. 28, 2002 (DE) ..... 102 39 467

(51) Int. Cl.[7] ..... A47C 21/00
(52) U.S. Cl. ..... 5/503.1; 5/658; 248/340
(58) Field of Search ..... 224/274, 407, 224/409, 411, 549, 553, 560, 561; 211/70.2, 204, 118, 195, 85.13, 59.4, 119.006; 5/503.1, 507.1, 504.1, 658, 600, 626; 108/47, 44, 152; 248/215, 241, 243, 340

(56) References Cited

U.S. PATENT DOCUMENTS

D164,503 S * 9/1951 Kerr ..... 211/70.2
4,944,434 A * 7/1990 Hamilton ..... 224/549
5,054,732 A * 10/1991 Sukup ..... 248/309.1
5,209,539 A * 5/1993 Atalay ..... 211/70.2
6,401,996 B1 * 6/2002 Thom et al. ..... 224/407

FOREIGN PATENT DOCUMENTS

DE 198 54 674 A1 7/2000

* cited by examiner

*Primary Examiner*—Michael Safavi
(74) *Attorney, Agent, or Firm*—McGlew and Tuttle, P.C.

(57) ABSTRACT

A holding device for medical instruments at a patient's bed, which are accommodated in suspension components. Holding devices for various medical instruments, such as respirators and accessories, infusion and secretion bags, measuring instruments and disposable articles, are used at patients' beds in many areas. A frequent drawback of prior-art holding devices is that the support at the patient's bed is unstable because the holding devices are suspended only loosely in a rail or handle. The holding device according to the present invention guarantees stable fastening at the patient's bed. It comprises a horizontal crossbeam (1), which is fixed on the sides of a peripheral strap (9) at the foot end of the patient's bed via, e.g., fixing means (3) designed as metal claws. Two vertical suspension carriers (2) with openings (6) for receiving suspension components have suspension sections (5) at their upper ends for suspension on the straps (9). It would also be possible to suspend the suspension sections (5) on a wall rail or cabinet rail.

17 Claims, 4 Drawing Sheets

HOLDING DEVICE FOR MEDICAL INSTRUMENTS AT A PATIENT'S BED

FIELD OF THE INVENTION

The present invention pertains to a holding device for medical instruments at a patient's bed.

BACKGROUND OF THE INVENTION

Holding devices for various medical instruments, such as respirators and accessories, infusion and secretion bags, measuring instruments, disposable articles, to name just a few examples, are used at patients' beds in hospitals, retirement homes and nursing homes as well as in private outpatient treatment.

A carrying device of this type for medical instrumentation to be used at varying sites, e.g., for routine examinations at the patient's bed, is described in DE 198 54 674 A1. The carrying device has a rack-like design and resembles a carrying bag. A horizontally arranged, rail-like holding section with a groove is preferably used as a means for hanging up or suspending the carrying device, the groove fitting, e.g., a standard rail mounted usually in the head area of patients' beds. Moreover, the carrying device may also be suspended in the foot area of a patient's bed or on correspondingly designed handles of bedside tables or drawers.

The drawback of the prior-art carrying device proved to be that its support at the patient's bed is unstable, because it is suspended only in a rail or handle. When the carrying device is transferred and suspended at another type of patient's bed, it must be readjusted vertically each time in its longitudinal direction.

SUMMARY OF THE INVENTION

The object of the present invention is to provide a holding device for medical instruments at a patient's bed, which makes possible a stable fixation at the patient's bed.

According to the invention, the holding device for medical instruments at a patient's bed comprises at least one essentially horizontally arranged crossbeam, which has means for fixing the crossbeam at the patient's bed. The fixing means may be, e.g., metal claws, which surround a tubular strap extending around the foot or head end of a patient's bed. Furthermore, the holding device comprises at least two essentially vertically arranged suspension carriers. The suspension carriers have an identical design and are used to receive suspension components. The suspension carriers are connected to the crossbeam and have suspension sections in their upper area for suspending the holding device at the foot or head end. The suspending may be performed on the above-mentioned tubular strap and also on a strap arranged on a wall or on a cabinet. The crossbeam and the suspension carrier are manufactured from a stable and load-bearing material, e.g., sheet metal or plastic.

The means for fixing the crossbeam at the patient's bed are preferably designed such that they can again be detached from the patient's bed in a simple manner and in a short time. This may be done, e.g., by means of screw connections. By loosening thumb screws, e.g., a metal claw can be turned to the side such that it will no longer surround the foot or head end of the patient's bed.

Moreover, the means for fixing the crossbeam may be designed such that they are adjustable at the patient's bed. This is especially advantageous in cases in which the holding device is used at patient beds of different widths, which also have, moreover, foot and head ends of such different designs that the suspension carriers would be arranged at different angles each time without fixation of the crossbeam of the carrying device at the patient's bed. The fixing means are preferably horizontally displaceable in relation to the middle part of the crossbeam and can be pulled out in the manner of a telescopic rail. The locking is performed by means of screw connections. These screw connections may be the same with which the fixing means, e.g., the metal claws, can be turned to the side on loosening the screw connections such that they will no longer surround the patient's bed.

In another advantageous embodiment, the suspension carriers have a plurality of openings, which are located on the side of the foot or head end facing the patient's bed and on the side of the foot or head area facing away from the patient's bed. The openings of the suspension carriers are preferably arranged at the same height and at equally spaced locations. Components to be suspended, which accommodate the necessary and desired medical instruments, can be suspended at these openings.

The holding device is advantageously designed as a collapsible holding device. The crossbeam is connected to the lower ends of the suspension carriers by means of hinges. As a result, the suspension carriers can be folded against the crossbeam such that all carriers are located in parallel to each other and can be transported in a compact manner.

Preferred exemplary embodiments of the holding device according to the present invention will be explained on the basis of the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENT

Figure 1:
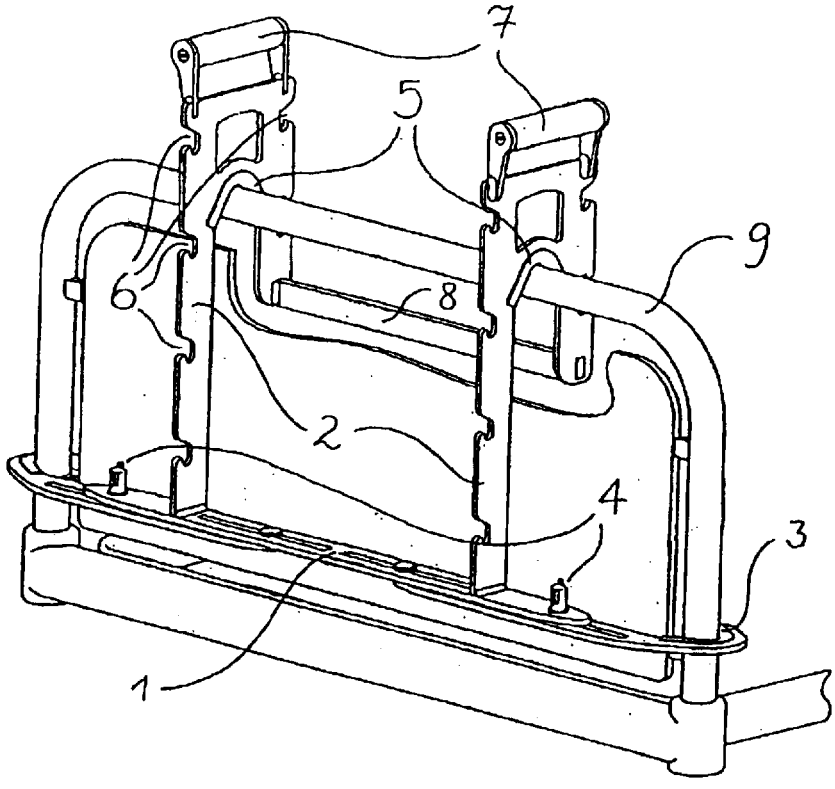
FIG. 1 is a perspective view showing a holding device which is mounted at the foot end of a patient's bed.

Referring to the drawings in particular, FIG. 1 shows a holding device, which is mounted at the foot end of a patient's bed. Mounting at a head end may be carried out in the same manner. The holding device comprises a horizontally arranged crossbeam 1 and two vertically arranged suspension carriers 2. The foot end of the patient's bed comprises a strap 9, which is designed as a circular, tubular strap and on which the suspension carriers 2 are suspended in their upper area via suspension sections 5. At its two ends, the crossbeam 1 has a fixing device 3, which is designed as metal claws and which surrounds the strap 9. The inner sections of the metal claws have exactly the same design as the suspension sections 5. The metal claws can be displaced horizontally in relation to the middle part of the crossbeam 1, comparably to the mechanism of a telescopic rail. The locking in of the width needed for the foot end of the patient's bed is performed by screws 4, which connect the metal claws to the middle part of the crossbeam 1. The suspension carriers 2 have openings 6, which are arranged at defined locking distances. The openings 6 of the identically designed suspension carriers 2, which said openings correspond to one another, are used in pairs to receive suspension components. The openings 6 are arranged on the side facing the patient's bed and on the side facing away from the patient's bed, so that a plurality of suspension components can be arranged on both the outer side of the foot end of the patient's bed and on the inner side of the foot end. Carrying handles 7, which make possible the convenient removal of the holding device from the foot end of the patient's bed as soon as the screws 4 for loosening the metal claws extending around the strap 9 have been loosened, are located at the upper ends of the suspension carriers. A standard rail section 8 is additionally used to stabilize the holding device.

Figure 2:
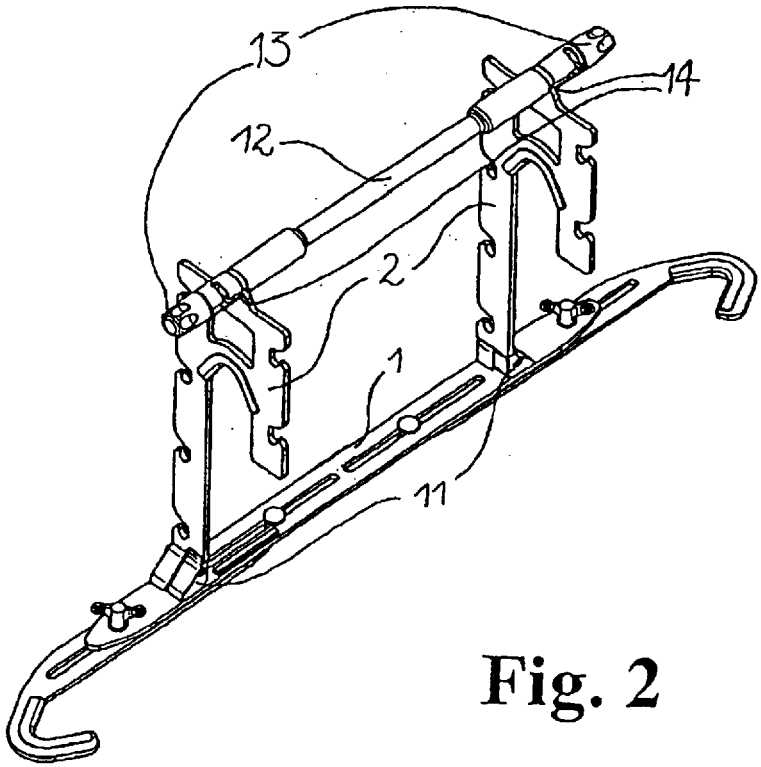
FIG. 2 is a perspective view showing a collapsible holding device.

FIG. 2 shows a collapsible holding device. The crossbeam 1 is connected here to the lower ends of the suspension carriers 2 by means of hinges 11. A cross bar 12 arranged at the upper ends of the suspension carriers 2 is used as a carrying handle, on the one hand, and stabilizes the holding device in the folded-up position, on the other hand, the cross bar 12 being braced at its two ends by screw grips 13 with mounting means 14 at the upper ends of the suspension carriers 2. After loosening the screw grips 13, the cross bar 12 can be removed, and the suspension carriers 2 are folded down at the hinges 11 in parallel to the crossbeam 1. The collapsible holding device is designed such that the cross bar 12 can again be fixed on the holding device with the screw grips 13 with the suspension carriers 2 folded down.

Figure 3:
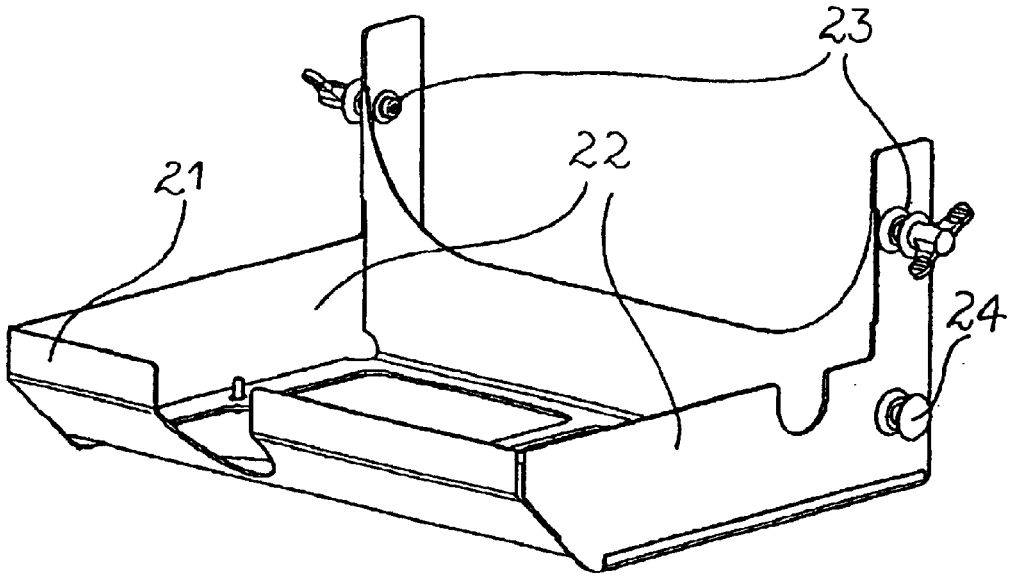
FIG. 3 is a perspective view showing a suspension component equipped with a plate tray.

FIG. 3 shows a suspension component equipped with a plate tray 21 for a holding device, not shown. Two upper pins 23 and two lower pins 24, one of which is visible in FIG. 3, are received by openings 6 of the holding device, the fixation being performed by means of screw connections at the upper pins 23. The pins 24 are located in the openings 6, not shown, without fixation. The suspension component is additionally stabilized as a result. The plate tray 21 may accommodate, e.g., a respirator, not shown, which is additionally supported and secured against slipping by the two cheeks 22.

Figure 4:
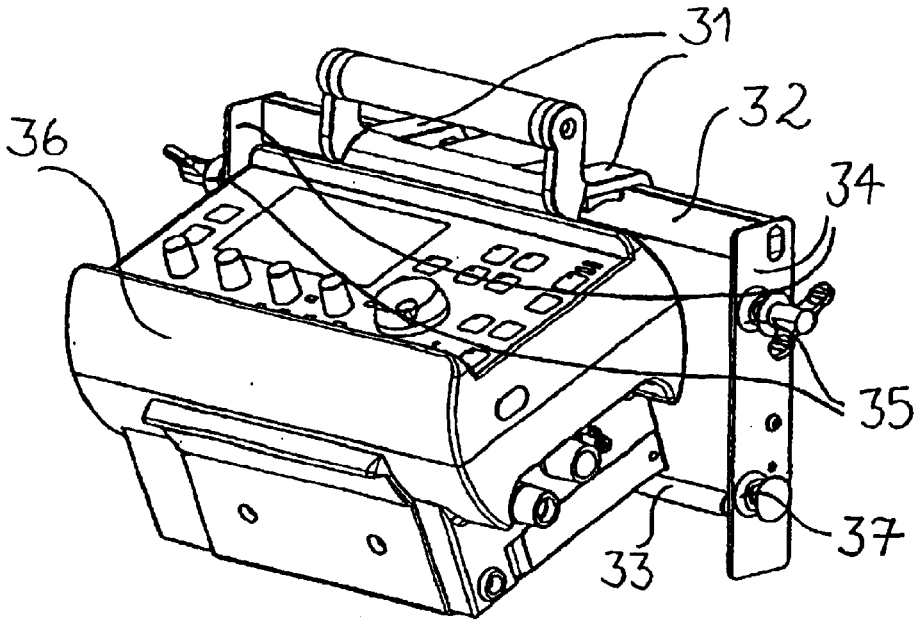
FIG. 4 is a perspective view showing a suspension component with an emergency respirator.

FIG. 4 shows a suspension component with an emergency respirator 36. Two upper pins 35 and two lower pins 37, one of which is visible, assume the same functions of the upper pins 23 and the lower pins 24 in FIG. 3. One of the two upper pins 35 and one of the two lower pins 37 are arranged at one of the two vertically extending plate cheeks 34, which are connected to one another rigidly by a standard rail section 32 at their upper ends and by a support strap 33 at their lower ends. The support strap 33 is used primarily to support the emergency respirator 36, which is suspended on the standard rail section 32 by means of rail claws 31.

Figure 5:
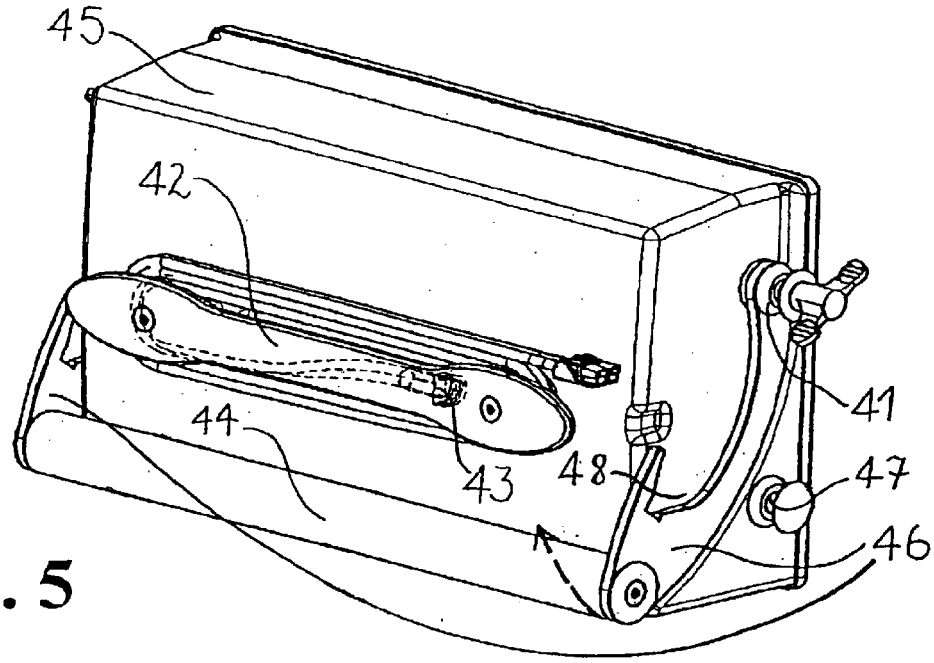
FIG. 5 is a perspective view showing a suspension component for receiving batteries.

FIG. 5 shows a suspension component for receiving batteries. The suspension component comprises a housing 45 for receiving, e.g., two lead storage batteries, which are not visible in FIG. 5. Two upper pins 41 and two lower pins 47, of which only one is visible and which have a function corresponding to that in FIGS. 3 and 4, are arranged here as well. A grip 44, which can be pivoted out upwardly at the housing 45 in the direction of the arrow indicated by a broken line, makes it possible to transfer the suspension component and to suspend it in another location, e.g., on a wall rail, not shown, or a cabinet rail. By means of two openings 48 shaped into each of the two lateral grip joints 46, the suspension component can be hooked into the said rail when the grip 44 is pivoted out upward. A front-side plate 42 at the housing 45 is used to wind up a cable indicated by broken lines and hides a cable outlet 43, which is thus protected from external damage, and which is likewise indicated by contours drawn in broken lines.

Figure 6:
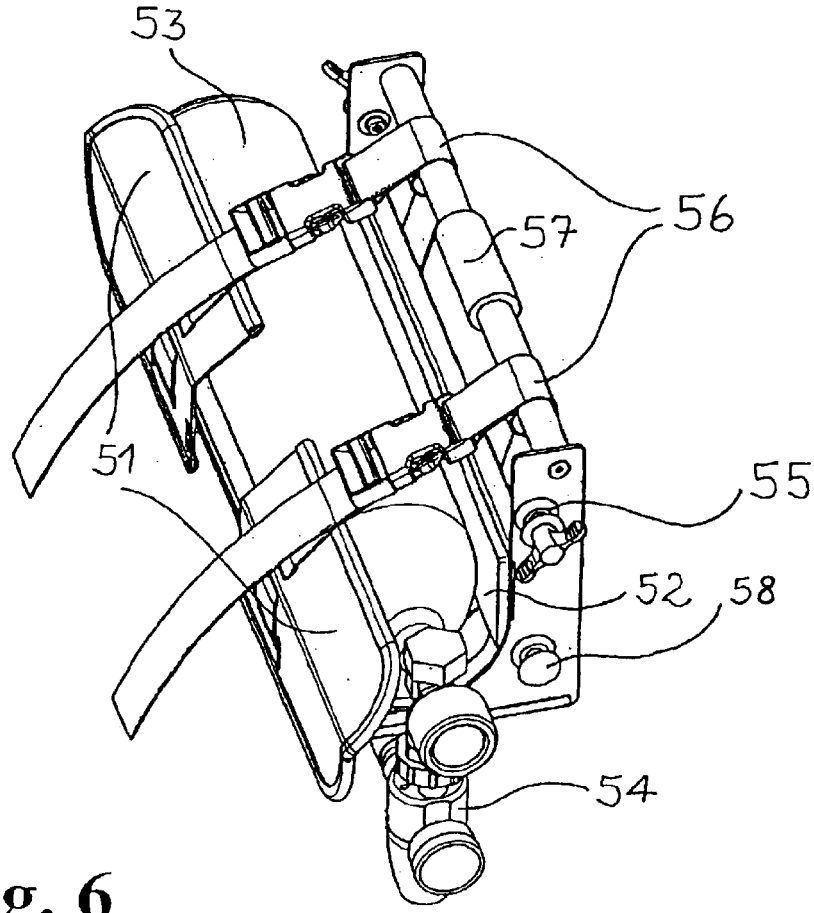
FIG. 6 is a suspension component designed as a cylinder holder.

FIG. 6 shows a suspension component designed as a cylinder holder, preferably receiving a pressurized gas cylinder 53 filled with oxygen, which is supported by a rear-side support surface 52. Two upper pins 55 and two lower pins 58, of which one each is visible in FIG. 6, correspond in terms of their functions to those in FIGS. 3 through 5. Cover plates 51, which are pressed by peripheral tensioning straps 56 against the pressurized gas cylinder 53, are arranged on the front side. The cover plates 51 are movable both angularly for adaptation to different cylinder diameters and horizontally along the longitudinal axis of a pressurized gas cylinder 53 for adaptation to different cylinder lengths. The cover plates 53 are displaced in the horizontal direction such that a pressure-reducing valve 54 arranged at the pressurized gas cylinder 63 is covered and thus protected from external damage. A carrying handle 57 arranged in the upper area of the suspension component is designed as a horizontally extending cross bar and is used at the same time to deflect the tensioning straps 56.

Figure 7:
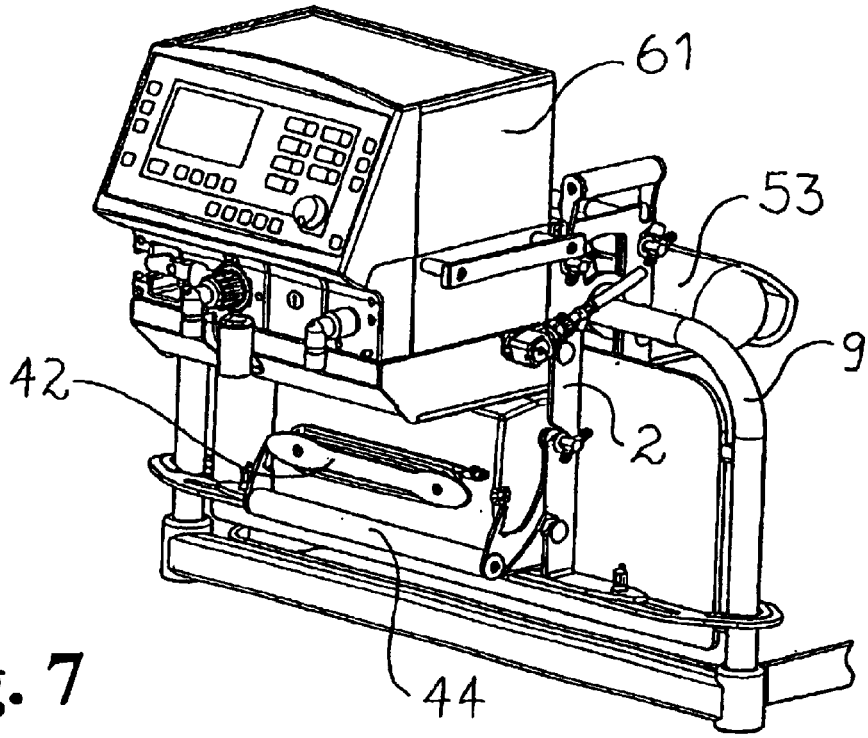
FIG. 7 is a perspective view showing a holding device with a suspension component, which is equipped with a plate tray and accommodates an intensive care respirator, with a suspension component for receiving batteries and with a suspension component designed as a gas cylinder holder.
Figure 8:
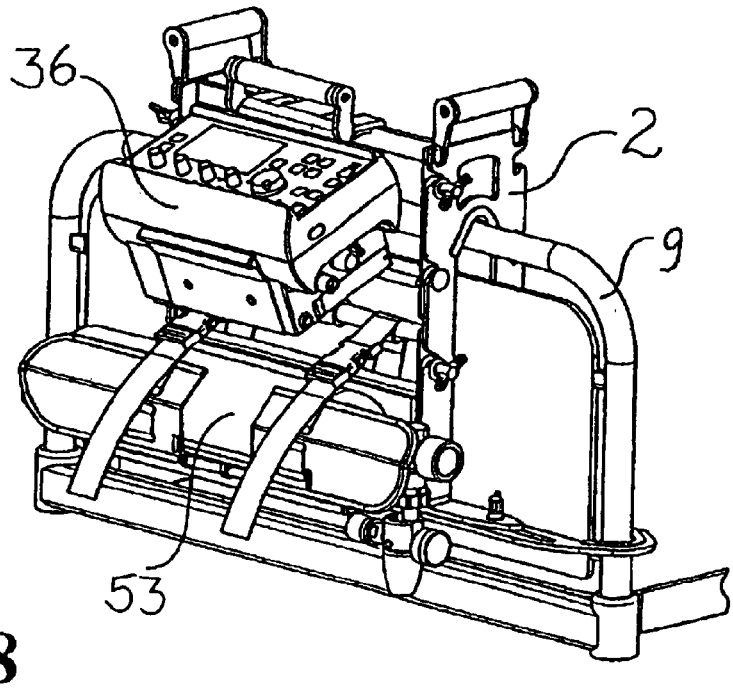
FIG. 8 is a perspective view showing a holding device with a suspension component with an emergency respirator and with a component designed as a gas cylinder holder.

FIGS. 7 and 8 show possible outfits of a holding device with different suspension components.

FIG. 7 shows a suspension component, which is equipped with a plate tray and accommodates an intensive care respirator 61 and is arranged on the outside at the top relative to a strap 9 of a foot end at a patient's bed. A suspension component for receiving batteries, not shown, is likewise arranged on the outside under it. A third suspension component is arranged as a cylinder holder for a pressurized gas cylinder 53 on the inside at the top relative to the strap 9.

FIG. 8 shows a holding device with two suspension components arranged on the outside relative to the strap 9. The suspension component at the top accommodates an emergency respirator 36 and the suspension component at the bottom accommodates a pressurized gas cylinder 53.

While specific embodiments of the invention have been shown and described in detail to illustrate the application of the principles of the invention, it will be understood that the invention may be embodied otherwise without departing from such principles.

What is claimed is:

1. A holding device for medical instruments at a patient's bed, the holding device comprising:

an essentially horizontally arranged crossbeam, including a fixing means for fixing said crossbeam at the patient's bed; and two essentially vertically arranged suspension carriers, said suspension carriers having an essentially identical design for accommodating suspension components, each of said suspension carriers being connected to said crossbeam and having upper areas with suspension sections for suspending the holding device at a foot or head end of the patient's bed, said crossbeam being connected to the lower end of said suspension carriers via hinges for folding up said suspension carriers in parallel to said crossbeam.

2. A holding device in accordance with claim 1, wherein said fixing means are detachable from the patient's bed.

3. A holding device in accordance with claim 1, wherein said fixing means are adjustable at the patient's bed.

4. A holding device in accordance with claim 2, wherein said fixing means are adjustable at the patient's bed.

5. A holding device in accordance with claim 1, wherein said fixing means includes screws and displaceable telescopic rail portions that can be locked on a middle portion of said crossbeam by said screws.

6. A holding system for medical instruments at a patient's bed, the holding system comprising:

a holding device with an essentially horizontally arranged crossbeam, including a fixing means for fixing said crossbeam at the patient's bed and two essentially vertically arranged suspension carriers, said suspension carriers having an essentially identical design for accommodating suspension components, each of said suspension carriers being connected to said crossbeam and having upper areas with suspension sections for suspending the holding device at the patient's bed; and a suspension component suspended from said holding device, said suspension carriers each having a plurality of openings on a side facing the patient's bed and on a side facing away from the patient's bed, the openings for receiving said suspension component, and said suspension component comprises a set of pins for engaging in a set of said openings and a connected structure with one of a tray portion, a battery seat and a gas cylinder seat.

7. A holding system in accordance with claim 6, further comprising another suspension component, said suspension component and said another suspension component being simultaneously suspended on said holding device, said another suspension component comprising a set of pins for engaging in a set of said openings and a connected structure.

8. A holding system in accordance with claim 6, wherein said fixing means includes fasteners and displaceable portions displaceable relative to a middle portion of said crossbeam and fixable to the middle portion of said crossbeam by said fasteners.

9. A holding system for medical instruments at a patient's bed, the holding system comprising:

a holding device with an essentially horizontally arranged crossbeam, including a connection portion connecting said crossbeam to the patient's bed and two essentially vertically arranged suspension carriers, said suspension carriers having an essentially identical design for accommodating suspension components, each of said suspension carriers being connected to said crossbeam and having upper areas with suspension sections for suspending the holding device; and a suspension component suspended from said holding device, said suspension carriers each having a plurality of openings an a side facing the patient's bed and on a side facing away from the patient's bed, the openings for receiving said suspension component.

10. A holding system in accordance with claim 9, wherein said connection portion is connectable to and detachable from the patient's bed.

11. A holding system in accordance with claim 9, wherein said connection portion is adjustable at the patient's bed.

12. A holding system in accordance with claim 9, further comprising screws wherein said connection portions are displaceable rail portions that can be locked on a middle portion of said crossbeam by said screws.

13. A holding system in accordance with claim 9, wherein said suspension carriers have said openings at the same level and at equally spaced locations.

14. A holding system in accordance with claim 9, wherein said suspension component composes a set of pins for engaging in a set of said openings and a connected structure with one of a tray portion, a battery seat and a gas cylinder seat.

15. A holding device for medical instruments at a patient's bed, the holding device comprising:

an essentially horizontally arranged crossbeam, including a fixing means for fixing said crossbeam at the patient's bed; and two essentially vertically arranged suspension carriers, said suspension carriers having an essentially identical design for accommodating suspension components, each of said suspension carriers being connected to said crossbeam and having upper areas with suspension sections for suspending the holding device at a foot or head end of the patient's bed, said suspension carriers each having a plurality of openings on a side facing the patient's bed and on a side facing away from the patient's bed, the openings for receiving suspension components.

16. A holding device in accordance with claim 15, wherein said suspension carriers have said openings at the same level and at equally spaced locations.

17. A holding system for medical instruments at a patient's bed, the holding system comprising:

a holding device with an essentially horizontally arranged crossbeam, including a connection portion connecting said crossbeam to the patient's bed and two essentially vertically arranged suspension carriers, said suspension carriers having an essentially identical design for accommodating suspension components, each of said suspension carriers being connected to said crossbeam and having upper areas with suspension sections for suspending the holding device, said crossbeam being connected to the lower end of said suspension carriers via hinges for folding up said suspension carriers in parallel to said crossbeam; and a suspension component suspended from said holding device.

* * * * *